United States Patent [19]

Skinner

[11] Patent Number: 4,518,377

[45] Date of Patent: May 21, 1985

[54] METHOD OF MAKING A CARTON

[75] Inventor: Edward A. Skinner, Welwyn Garden City, England

[73] Assignee: Elopak Limited, Hertfordshire, England

[21] Appl. No.: 376,557

[22] Filed: May 10, 1982

[30] Foreign Application Priority Data

May 11, 1981 [GB] United Kingdom ..... 8114277

[51] Int. Cl.[3] ..... B31B 1/64

[52] U.S. Cl. ..... 493/58; 493/87; 493/133

[58] Field of Search ..... 229/48 SA, 48 SB, 48 T, 229/17 G, 17 R; 206/601, 631; 493/87, 58, 61, 73, 133, 209, 148

[56] References Cited

U.S. PATENT DOCUMENTS

| | | | |
|---|---|---|---|
| 3,200,557 | 8/1965 | Schwenk | 493/165 X |
| 3,270,940 | 9/1966 | Egleston et al. | 229/48 R X |
| 3,291,369 | 12/1966 | Crawford | 229/17 G X |
| 3,295,739 | 1/1967 | Wilcox | 229/17 G |
| 3,319,868 | 5/1967 | Huang et al. | 229/17 G |
| 3,471,076 | 10/1969 | Crawford | 229/17 G |
| 4,244,158 | 1/1981 | Nelham | 53/133 X |

*Primary Examiner*—James F. Coan

*Attorney, Agent, or Firm*—Wood, Dalton, Phillips, Mason, & Rowe

[57] ABSTRACT

A gable-topped carton blank is cut from paperboard coated on both faces with thermoplastics. In the top closure, a loop of sub-panels provides a sealing fin. Each of two opposite sub-panels is folded inwardly upon itself and one is opened-out in forming a pouring spout. To reduce the tendency for the internal surface middle zone of this sub-panel to adhere to the internal surfaces of two other upper sub-panels during heat-sealing, these latter surfaces are formed in the blank with embossed recesses corresponding somewhat in position with recesses in sealing jaws.

8 Claims, 4 Drawing Figures

METHOD OF MAKING A CARTON

BACKGROUND OF THE INVENTION

1. Field of the Invention

This invention relates to a packaging carton blank, a method of making a carton therefrom and a carton made by the method, particularly in respect of the packaging of liquid.

2. Description of the Prior Art

Gable-topped packaging cartons with extensible pouring spouts are conventional. One of the problems with the gable form of top closure is unreliable sealing because of its relatively complicated construction. Reliable sealing thereof becomes even more difficult to attain when the top closure incorporates an extensible spout provided by one of the sub-panels of the loop of upper sub-panels serving to form the sealing fin and one of the sub-panels of the loop of lower sub-panels serving to obturate the carton top, because the spout should be relatively easy to open, yet this requirement is not readily reconcilable with good sealing together of the sub-panels forming the sealing fin.

U.S. Pat. No. 3,270,940 discloses a gable-topped carton which is formed from a blank consisting of paperboard coated on both sides with thermoplastics and in which the middle zones of the internal and external surfaces of the upper sub-panel of such a spout, or each such spout when there are spouts at the respective ends of the top closure, are coated with an adhesive material, for example of the organo-siloxane type. The corresponding parts of the internal surfaces of the two adjacent upper sub-panels may also be coated with the adhesive material. For the purpose of increasing the degree and durability of liquidtightness of the closure, the jaws used in sealing the fin may apply extra pressure to selected areas of the closure parts, producing in the closure plies indentations or embossments which effectively close up incipient liquid escape channels. Such an area is a rectangular embossed area on one of the said two adjacent upper sub-panels and adapted to effect blocking of an incipient channel in the fin along the inner lateral edge of a sealing strip panel extension. The area can be centrally relieved to avoid interference with the spout.

It has been found in practice that, in spite of these measures, the middle zone of the upper sub-panel of the spout may still adhere firmly to the internal surfaces of the two adjacent sub-panels so that the spout cannot be readily opened and thus becomes badly distorted or torn in opening it.

SUMMARY OF THE INVENTION

According to one aspect of the present invention, there is provided a blank from which a carton is to be made, comprising a first portion of one surface of said blank and in a general plane of said surface, a second portion of said surface and in said plane for adhering to said first portion, and third and fourth portions of said surface, characterised in that said fourth portion lies slightly out of said plane but substantially parallelly thereto for coming closely face-to-face with said third portion but remaining substantially unadhered thereto.

According to another aspect of the present invention, there is provided a carton comprising a first internal surface portion, a second internal surface portion arranged in face-to-face contact with said first internal surface portion and in a common plane therewith, and third and fourth internal surface portions arranged face-to-face at respective opposite sides of said plane, characterised in that said fourth internal surface portion lies slightly spaced away from said plane but substantially parallelly thereto and is substantially unadhered to said third internal surface portion.

According to a further aspect of the present invention, there is provided a method of making a carton, including providing a blank including first, second, third and forth portions of one surface of said blank all in a general plane of said surface, folding said blank, bringing said first and second portions together face-to-face and bringing said third and fourth portions together face-to-face, and adhering said first and second portions together by introducing the first, second, third and fourth portions between the jaws of a pair of jaws and pressing the first and second portions together by means of the jaws while the fourth portion is situated at a recess in one of the jaws so as not to bear firmly on the third portion, characterised in that, prior to folding said blank, said blank is embossed to cause said fourth portion to lie out of said plane but substantially parallelly thereto, so that there is a corresponding depression in said one surface.

These three aspects of the invention have the advantage of improving the degree to which the third and fourth portions of zones of the internal surface of the carton co-extensive with the pressing jaws are discouraged from adhering together.

BRIEF DESCRIPTION OF THE DRAWINGS

In order that the invention may be clearly understood and readily carried into effect, reference will now be made, by way of example, to the accompanying drawings, in which.

DESCRIPTION OF THE PREFERRED EMBODIMENTS

The carton blank and carton now to be described are a modification of the carton blank and carton of U.S. patent application Ser. No. 261,799, to which reference may be made for full details of the manners of use of the blank and the carton.

Figure 1:
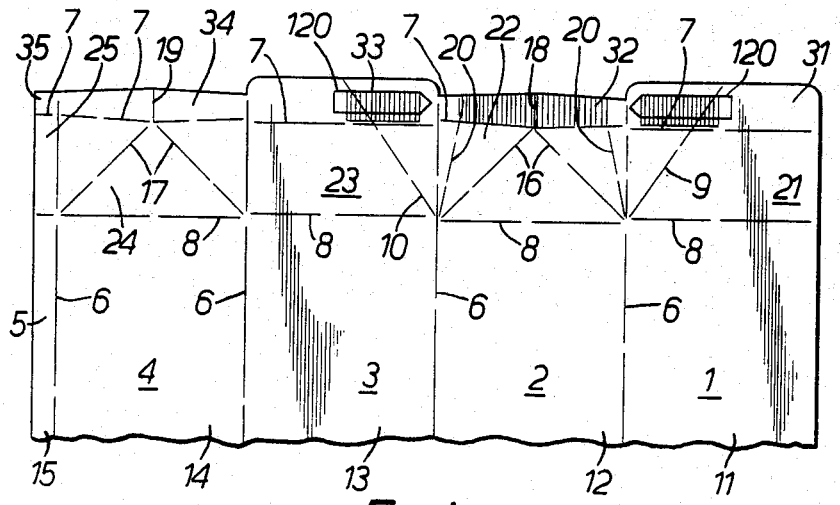
FIG. 1 shows a fragmentary plan view of gable-topped carton blank.

Referring to FIG. 1, the carton blank is designed to form a gable-topped carton for containing a consumable liquid, for example milk or orange juice. The blank has been cut from a sheet of conventional material consisting of paperboard coated on both faces with thermoplastics. The blank consists of five panels 1 to 5, of which the panel 5 is a sealing strip which is to be heat-sealed in a conventional way to the panel 1 in an overlapping manner, in order to form a sleeve. The panels 1 to 5 are interconnected by lines of weakness in the form of respective score lines 6 extending perpendicularly to the row of panels 1 to 5. By means of score lines 7 and 8 and other score lines(not shown)extending perpendicularly to the score lines 6, the panels 1 to 5 are divided into rows of sub-panels. These rows of sub-panels include bottom closure sub-panels (not shown), a row of side wall sub-panels 11 to 15, a row of lower top closure sub-panels 21 to 25, and a row of higher top closure sub-panels 31 to 35.

It will be appreciated that the sub-panels 21 to 25 will serve to obturate the top of the carton, while the sub-panels 31 to 35 will serve to provide a sealing fin of the gable top closure. The sub-panels 21 and 31 are formed with an oblique score line 9 extending from the corner of the sub-panel 21 nearer to the sub-panel 12 to a location about mid-way along the outer longitudinal edge of the sub-panel 31. Similarly, an oblique score line 10 extends from the corner of the sub-panel 23 nearer to the sub-panel 12 to about mid-way along the outer longitudinal edge of the sub-panel 33. The sub-panel 22 is formed with two score lines 16 which extend from the centre of its score line 7 to the corners of the sub-panel 22 nearest the sub-panels 11 and 13, respectively. Similarly, the sub-panel 24 is formed with two score lines 17 which extend from the centre of its score line 7 to its corners nearest to the sub-panels 13 and 15, respectively. A score line 18 extends from the junction of the score lines 16 across the sub-panel 32 parallelly to the score lines 6, while, similarly, score line 19 extends from the junction of the score lines 17 across the sub-panel 34 parallelly to the score lines 6. The blank as so far described in conventional. However, the sub-panels 22 and 32 are formed with two score lines 20 which commence from locations on the outer longitudinal edge of the sub-panels 32 spaced inwardly from the ends of the sub-panel 32, extend across the sub-panel 32 parallelly to the score line 6 to its score line 7, and thence extend obliquely to those corner regions of the sub-panel 22 nearest the sub-panels 11 and 13, respectively. Each score line 20 is spaced from the score line 18 along the sub-panel 32 to an extent of a major portion of the length of each sub-sub-panel into which the sub-panel 32 is divided by the score line 18, for example by an extent equal to about four-tenths of the length of the sub-panel 32. The blank has two arrow-shaped embossments 120 which are formed during the cutting and scoring of the blank and which provide depressions in the illustrated surface of the blank, which will be the internal surface of the carton. Since undesired adhesion of the sub-panels 31 and 33 to the sub-panel 32 is most likely to occur at the cut edges of the sub-panel 32, the embossments 120 are so situated as to come opposite to the cut edges during sealing of the top closure of the carton.

Figure 2:
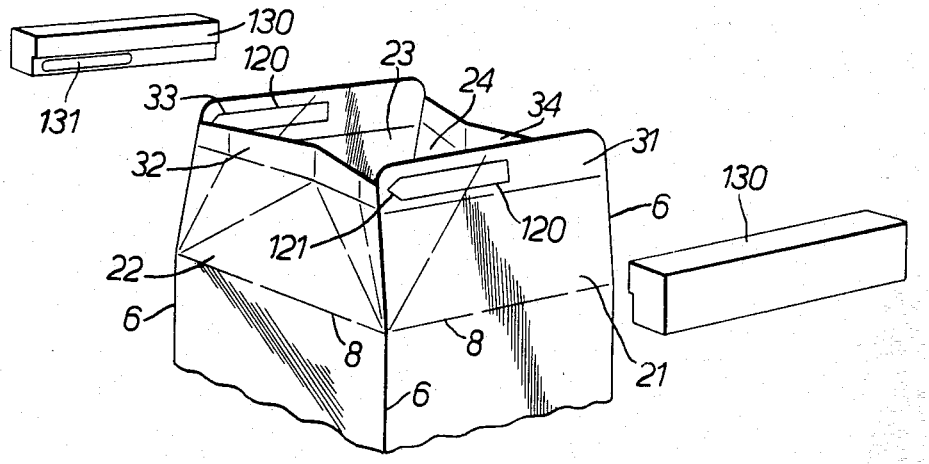
FIG. 2 shows a fragmentary perspective view of an open-topped gable-topped carton formed from the blank.

The sleeve formed from the blank of FIG. 1 has its bottom sealingly closed in a conventional manner and then has its top closure pre-broken in a conventional manner to bring the top closure to the condition shown in FIG. 2. In the condition shown in FIG. 2, the sub-panels 32 and 34 have been pressed inwardly slightly about the score lines 6, the sub-panels 22 and 24 have been pressed inwards slightly about the score lines 6 and their score lines 8, and the sub-panels 21, 23, 31 and 33 have been inclined inwards slightly about the relevant score lines 8.

Figure 3:
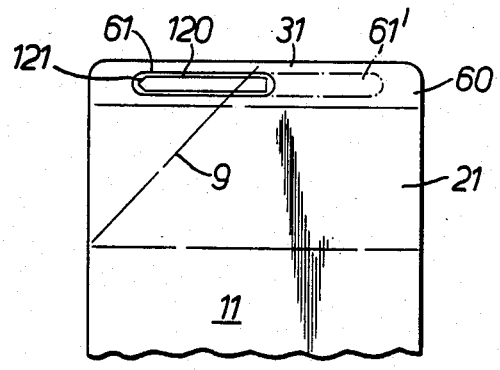
FIG. 3 is a fragmentary side elevation of the carton with its top closure sealed.

In order to discourage any tendency for the internal surace portions of the sub-panel 32 between the score lines 20 to become sealed to the sub-panels 31 and 33 under the pressure of a pair of clamping jaws 130, the clamping jaws being provided with respective shallow elongate recesses extending along the jaws and slightly larger than the embossment depression 120, as seen in FIG. 3, so as to relieve the pressure on those internal surface portions, these recesses thus leaving a substantially uncompressed portion of the fin 60 as indicated at 61' in FIG. 3.

To reduce this tendency further, that portion of the sub-panel 32 between the score lines 20 may have its internal thermoplastics surface coated with an abhesive, in this case silicone resin, during production of the blank, while those portions of the sub-panels 31 and 33 which are co-extensive with this portion of the sub-panel 32 in the top closure may have their internal thermoplastics surfaces coated with the same abhesive at the same time. These coatings of abhesive are shown by means of parallel-line hatching in FIG. 1.

The embossments 120 effectively reinforce the effect of the recess 131 in the jaws 130, and are therefore arranged to come opposite to these recesses during pressure-sealing. This can be appreciated from FIG. 3, where the embossment 120 substantially coincides with part of the uncompressed portion 61 of the fin 60. The embossments of course also reinforce the effect of the abhesive coatings. The pointed end 121 of each embossment 120 is directed towards that end of the fin 60 at which the customer is to commence opening of the top closure, i.e. that end at which the pouring spout is situated. The uncompressed portion 61 can be extended as indicated at 61' to lie over most of the length of the fin, in a case where it is desired that the carton should be openable selectively at both ends, in which case the embossments, the abhesive and the score lines 9 will be supplemented symmetrically with respect to both ends of the carton.

Figure 4:
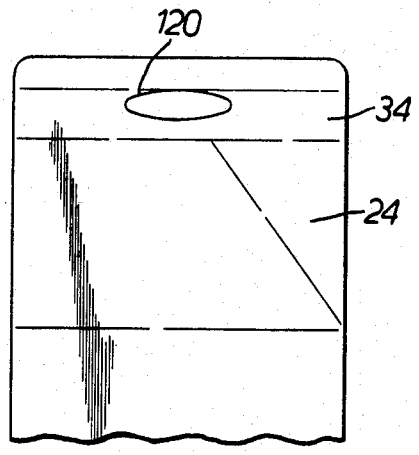
FIG. 4 shows a view similar to FIG. 3 of a modified version of the carton.

In the version shown in FIG. 4, the embossments 120 are of a horizontal shallow oval form and extend over the middle three-tenths, approximately, of the length of the sub-panels 31 and 34.

I claim:

1. A method of making a carton, comprising the steps of:

providing a sheet material defining a planar first surface having first, second, third and fourth portions;

embossing said sheet material to cause said fourth portion to lie out of the plane of said surface but substantially parallel thereto to define a corresponding depression in said one surface;

folding said embossed sheet material;

bringing said first and second portions together face-to-face;

bringing said third and fourth portions together face-to-face;

adhering said first and second portions together by introducing the first, second, third and fourth portions between the jaws of a pair of jaws; and pressing the first and second portions together by means of the jaws while the fourth portion is situated at a recess in one of the jaws so as not to bear firmly on the third portion.

2. The method of making a carton of claim 1 including the step of providing an abhesive coating on said fourth portion of said first surface.

3. The method of making a carton of claim 1 including the step of providing an abhesive coating on a portion of said surface defined by said depression.

4. The method of making a carton of claim 1 including the step of providing an abhesive coating on a portion of said surface defined by said depression and adjacent thereto.

5. The method of making a carton of claim 1 wherein said third portion is formed to define an edge portion thereof overlying said depression in the fourth portion.

6. A method of making a carton, including providing sheet material including first, second, third, and fourth portions of one surface of said sheet material all in a general plane of said surface, folding said sheet material, bringing said first and second portions together face-to-face and adhering said first and second portions together by introducing the first, second, third, and fourth portions between the jaws of a pair of jaws and pressing the first and second portions together by means of the jaws while the fourth portion is situated at a recess in one of the jaws so as not to bear firmly on the third portion and reduce tendency for adhesion between the third and fourth portions compared to that between the first and second portions, and embossing said sheet material prior to folding said sheet material, to cause said fourth portion to lie out of said plane but substantially parallel thereto, so that there is a corresponding depression in said one surface for further reducing adhesion between the third and fourth portions.

7. A method according to claim 6 wherein said sheet material comprises a row of first, second, third and fourth panels interconnected by lines of weakness, other lines of weakness extending along said row and dividing the row of panels into rows of sub-panels, the rows of sub-panels including an inner row of end closure obturating sub-panels for obturating one end of the carton and an outer row of end closure sealing sub-panels for forming a sealing fin at said one end, said outer row comprising respective first, second, third and fourth sealing sub-panels of which the second and fourth sub-panels are provided centrally with transverse lines of weakness to form respective pairs of sub-sub-panels, said inner row comprising first, second, third and fourth obturating sub-panels of the respective panels of which the second and fourth sub-panels are formed with oblique lines of weakness dividing these sub-panels into sub-sub-panels, the oblique lines of each of the second and fourth obturating sub-panels extending from the center of that edge region of each of the second and fourth obturating sub-panels furthest from the middle of its panel to those corner zones of the sub-panel furthest from said edge region, said one surface constituting that surface of said sheet material which is to be the internal surface of said carton, said first and second surface portions being of said first and second sealing sub-panels, respectively, and said third and fourth surface portions being of said second and first sealing sub-panels, respectively, with said third surface portion extending at a location central of said second sealing sub-panel.

8. A method according to claim 7 wherein said fourth surface portion extends over about one-third of the dimension of said first sealing sub-panel along said row of panels.

* * * * *